United States Patent [19]

Kern et al.

[11] Patent Number: 4,995,085

[45] Date of Patent: Feb. 19, 1991

[54] HEARING AID ADAPTABLE FOR TELEPHONE LISTENING

[75] Inventors: Reinhard Kern; Gerhard Krauss, both of Nuremberg; Helmut Schlosser, Roettenbach, all of Fed. Rep. of Germany

[73] Assignee: Siemens Aktiengesellschaft, Berlin and Munich, Fed. Rep. of Germany

[21] Appl. No.: 255,540

[22] Filed: Oct. 11, 1988

[30] Foreign Application Priority Data

Oct. 15, 1987 [DE] Fed. Rep. of Germany ..... 3734946

[51] Int. Cl.[5] ..... H04R 25/00

[52] U.S. Cl. ..... 381/68.2; 381/68

[58] Field of Search ..... 381/68.2, 68, 71, 72, 381/93, 123, 98, 102, 108, 95; 379/52

[56] References Cited

U.S. PATENT DOCUMENTS

| | | | |
|---|---|---|---|
| Re. 29,273 | 6/1977 | Reiffin | 330/271 |
| 2,345,761 | 4/1944 | Lybarger | 330/91 |
| 2,530,621 | 11/1950 | Lybarger | 379/52 |
| 3,110,868 | 11/1963 | Pearson et al. | 330/271 |
| 3,301,955 | 1/1967 | Clements, Jr. | 381/68 |
| 3,571,514 | 3/1971 | Wruk | 381/68 |
| 3,997,849 | 12/1976 | Thommen | 330/265 |
| 4,119,814 | 10/1978 | Harless | 381/68.2 |
| 4,467,145 | 8/1984 | Borstel | 381/123 |
| 4,490,585 | 12/1984 | Tanaka | 379/52 |
| 4,596,899 | 6/1986 | Wojcik et al. | 381/68.4 |
| 4,622,440 | 11/1986 | Slavin | 381/68.2 |
| 4,689,818 | 8/1987 | Ammitzboll | 381/68 |
| 4,689,820 | 8/1987 | Köpke et al. | 340/517 |
| 4,764,957 | 8/1988 | Angelini et al. | 381/98 |
| 4,823,384 | 4/1989 | Lindsay | 379/52 |

FOREIGN PATENT DOCUMENTS

| | | | |
|---|---|---|---|
| 3012393 | 10/1981 | Fed. Rep. of Germany | 379/52 |
| 209764 | 4/1940 | Sweden . | |
| 596238 | 3/1978 | U.S.S.R. | 381/68 |

OTHER PUBLICATIONS

"Telephone Coupler", Hearing Instruments, Jun. 1986, p. 37.

*Primary Examiner*—Jin F. Ng
*Assistant Examiner*—M. Nelson McGeary, III
*Attorney, Agent, or Firm*—Hill, Van Santen, Steadman & Simpson

[57] ABSTRACT

A hearing aid has a microphone, an amplifier and a receiver and at least one frequency-defining element in series with a switch connected to the amplifier. For telephone listening, the switch is closed and the frequency-defining element lowers the high frequencies in the incoming signal from the telephone receiver so that a comfortable tone results for the hearing-impaired person using the telephone. The frequency-defining element may be a part of a frequency-dependent voltage divider, a part of a frequency-dependent negative feedback circuit, or a component in a resonant circuit.

12 Claims, 1 Drawing Sheet

HEARING AID ADAPTABLE FOR TELEPHONE LISTENING

BACKGROUND OF THE INVENTION

1. Field of the Invention

The present invention is directed to a hearing aid, and in particular to a hearing aid adaptable for telephone listening to produce a tone comfortable for the user.

2. Description of the Prior Art

Hearing aids are known which include a separate coil, in addition to the microphone normally used, to capture the magnetic field from a telephone receiver, and to convert it into corresponding signals for the hearing-impaired person. The accommodation of such an additional coil, however, is frequently impossible for space reasons in smaller hearing aids, such as in-the-ear hearing aids. Although it is theoretically possible to conduct telephone listening using the microphone present in the hearing aid for normal use, acoustic reproduction quality is poor when this microphone is used to receive signals from the telephone receiver because of the closeness of the hearing aid microphone to the transmitting speaker in the telephone hand piece. Hearing-impaired persons complain that an unnatural, piercing, shrill tone results under such circumstances.

SUMMARY OF THE INVENTION

It is an object of the present invention to provide a hearing aid adaptable for telephone listening so that the tone quality heard by the user is natural and comfortable.

The above object is achieved in a hearing aid constructed in accordance with the principles of the present invention which includes a frequency-defining element connected to the hearing aid amplifier. The frequency-defining element lowers amplitudes of the higher frequencies in the signal incoming to the hearing aid from the telephone hand piece speaker. The uncomfortable tone which hearing-impaired persons observe when using the telephone with a conventional hearing aid results from unnaturally strong treble reproduction. This unnaturally strong treble reproduction is compensated by the frequency-defining element. The frequency-defining element is a suitably dimensioned element connected in series with a switch which is closed for telephone use. The frequency-defining element may be a component in a frequency-dependent voltage divider, a component in a frequency-dependent negative feedback loop, or a component in a resonant circuit.

In one embodiment of the invention, the frequency-defining element is a capacitor having a selected suitable capacitance.

In an embodiment wherein the frequency-defining element is a part of a resonant circuit, the inductance of the hearing air receiver forms the resonant circuit in combination with the frequency-defining element, which is a capacitor switched into the circuit during telephoning. This resonant circuit attenuates the high frequencies so that a comfortable tone results.

A hearing aid wherein a capacitor connected in parallel with the receiver forms a resonance circuit in combination with the inductance of the receiver for attenuating high frequencies is known from European Application No. 0 124 798, corresponding to U.S. Pat. No. 4,689,818. In combination with an actuator, however, this capacitor functions to match the frequency curve during normal hearing via the microphone. The adjustment normally takes place in the factory, or is undertaken by a hearing aid technician. This known hearing aid thus does not permit selective adaptation to the special conditions present during telephone use, which adaptation can be undertaken by the hearing-impaired person during such telephone use.

The aforementioned circuitry of European Application No. 0 124 798 may, however, for the basis for a further embodiment of the present invention with a series circuit consisting of the switch and the frequency-defining element (i.e., a suitably dimensioned capacitor) connected in parallel with the receiver which already includes a parallel circuit consisting of a further capacitor and an actuator, as set forth in the European application. The series circuit of the capacitor and the switch could, however, alternatively be connected in parallel with a further capacitor which would replace the known series circuit of the capacitor and the actuator.

DESCRIPTION OF THE PREFERRED EMBODIMENTS

Figure 1:
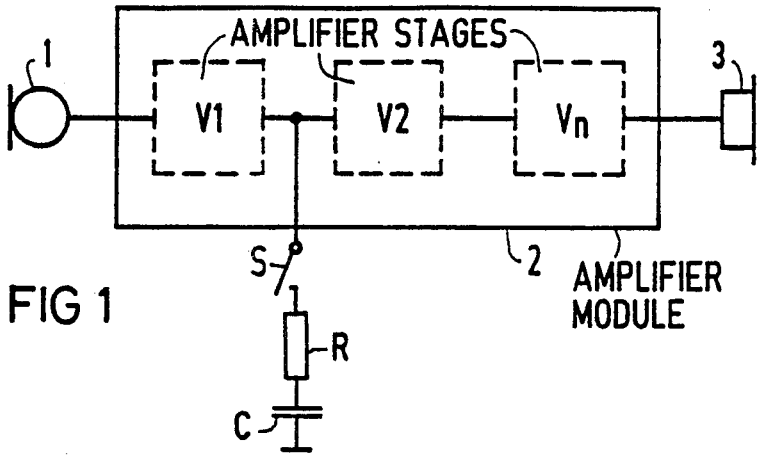
FIG. 1 is a schematic circuit diagram of a first embodiment of a hearing aid constructed in accordance with the principles of the present invention.

The hearing aid shown in FIG. 1 includes a microphone 1, an amplifier module 2 and a receiver 3. The amplifier module 2 includes a plurality of amplifier stages V1, V2 . . . Vn. In accordance with the principles of the present invention, one of the amplifier stages, such as the first amplifier stage V1, is followed by a series circuit consisting of a capacitor C and a switch S and an ohmic resistor R. These components form a frequency-dependent voltage divider.

Figure 2:
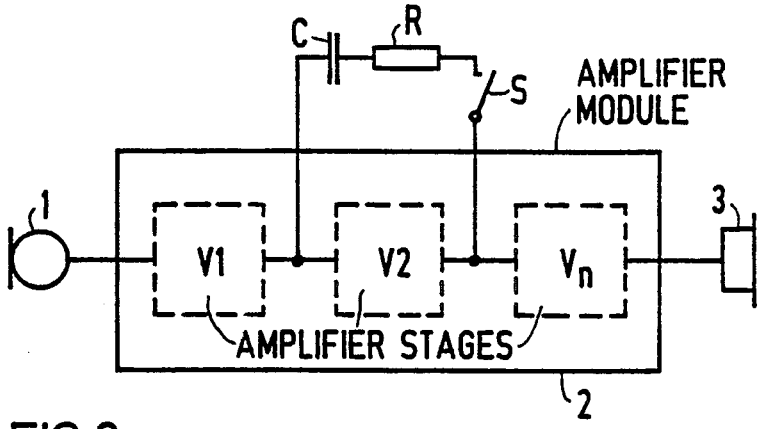
FIG. 2 is a schematic circuit diagram of a second embodiment of a hearing aid constructed in accordance with the principles of the present invention.

In the embodiment of FIG. 2, the same components are indicated with the same reference symbols. Differing from the exemplary embodiment of FIG. 1, the series circuit in the embodiment of FIG. 2, again consisting of the capacitor C, the switch S and the ohmic resistor R, are connected to form a frequency-dependent negative feedback loop connected between the input and the output of the second amplifier stage V2.

The frequency-dependent voltage divider of FIG. 1 or the frequency-dependent negative feedback loop in the embodiment of FIG. 2 can be allocated to any one of the amplifier stages V1, V2 . . . Vn within the amplifier module 2.

In the embodiments of FIGS. 1 and 2, the switch S in the series circuit is closed by the hearing aid wearer only during use of the telephone. Due to the capacitance of the capacitor C, the amplitudes of high frequencies incoming to the microphone 1 from the speaker of the telephone handset are lowered to such an extent that a comfortable tone results for the hearing-impaired person during use of the telephone. At the conclusion of the telephone call, the switch S is again opened by the hearing-impaired wearer. The influence of the series circuit is thus interrupted, and normal operation of the hearing aid again takes place.

Figure 3:
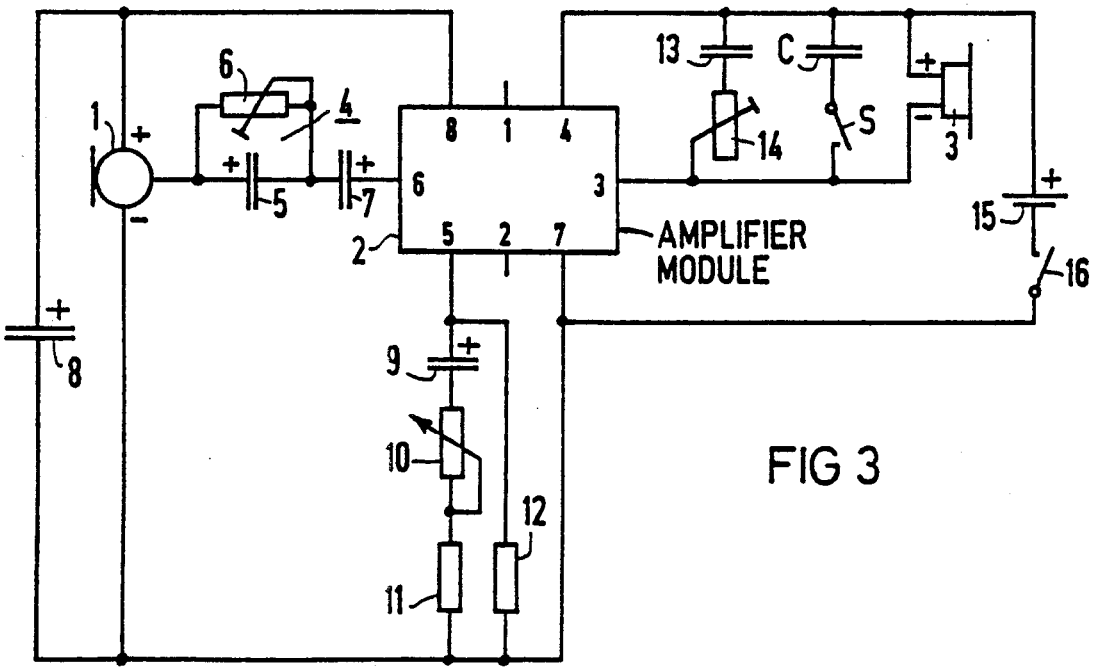
FIG. 3 is a schematic circuit diagram of a third embodiment of a hearing aid constructed in accordance with the principles of the present invention.

In the embodiment of FIG. 3, a microphone 1, an amplifier module 2 (in the form of an IC package) and an receiver 3 are again provided as part of the hearing aid. The hearing aid in the embodiment of FIG. 3 also includes a tone control 4, consisting of a capacitor 5 and a potentiometer 6. Blocking capacitors 7, 8 and 9 are so provided. A volume potentiometer 10 is connected in series with resistor 11, to set a voltage drop, and that series branch is connected in parallel with a resistor 12 for the purpose of setting the current. A battery 15 having an on/off switch 16 is also provided. To this extent, the circuit shown in FIG. 3 essentially corresponds to the circuit disclosed in the aforementioned European Application No. 0 124 798 for tone improvement in the use of resonant peak control. As already indicated above, this circuit may result in an unnaturally piercing, shrill tone when used to transmit signals from the speaker of a telephone handset.

To make this known circuit usable for telephoning as well, in accordance with the principles of the present invention the circuit shown in FIG. 3 additionally includes a capacitor C and a switch S connected in a series branch. This series branch is connected in parallel with the receiver 3. This series branch is also connected in parallel with the known series circuit consisting of the capacitor 13 and the actuator 14. The capacitor C is roughly twice as large as the capacitor 13. In a preferred exemplary embodiment, for example, the capacitor 13 has a capacitance of 0.047$\mu$F and the capacitor C has a capacitance of 0.1$\mu$F. Smaller or higher values for the capacitor C are, however, possible. The capacitor C may, for example, be roughly the same size as the capacitor 13, or may be larger than the 0.1$\mu$F selected in the preferred exemplary embodiment. As the capacitance of the capacitor C increases beyond twice the value of the capacitor 13, however, the volume decreases. The roughly double value of the capacitance C with reference to the capacitor 13 is the optimum value. In other circuit embodiments wherein no parallel circuit consisting of the capacitor 13 and the actuator 14 are present, or wherein only the capacitor 13 is present, a value for the capacitance of the capacitor C should be selected which is approximately 0.15$\mu$F. This value corresponds to the sum of the selected capacitance in the previously-described embodiment wherein both capacitors 13 and C are present.

In the embodiment of FIG. 3, the series circuit consisting of the capacitor C and the switch S is connected directly between the positive and negative outputs of the receiver 3. This series circuit may, however, alternatively be connected between the negative output of the receiver and the negative pole of the battery. The same result occurs because the series circuit consisting of the capacitor C and the switch S is still connected in parallel with the receiver 3, but via the battery 15. The battery 15 represents a short circuit in terms of alternating voltage.

The switch S may be a switch separate from the on/off switch 16, or the two switches can be combined. The switch S may be remote-controlled, as described in a hearing aid disclosed in European Application No. 0 175 909. The switch S may alternatively be activated by the magnetic field which is generated by the magnet in many telephone hand sets. In this case the switch S can be, for example, a reed contact.

Although modifications and changes may be suggested by those skilled in the art it is the intention of the inventors to embody within the patent warranted hereon all changes and modifications as reasonably and properly come within the scope of their contribution to the art.

We claim as our invention:

1. A hearing aid adaptable for telephone listening comprising:

a microphone which receives incoming audio signals, said incoming audio signals sometimes including telephone audio signals;

means connected to said microphone for amplifying output signals from said microphone, thereby producing amplified audio signals;

a receiver connected to an output of said means for amplifying;

first means connected to said means for amplifying for lowering the amplitudes of high frequency components in said amplified audio signals;

second means connected to said means for amplifying for lowering the amplitudes of high frequency components in said amplified audio signals differently from said first means for lowering so that said telephone audio signals in said amplified audio signals are comfortable for listening by a user of the hearing aid; and switch means in series with said second means and operable by said user of said hearing aid for actuating said second means for lowering the amplitudes of high frequency components during telephone listening by said user when said telephone audio signals are thus included in said audio signals.

2. A hearing aid as claimed in claim 1, wherein said second means for lowering high frequencies is a frequency-dependent voltage divider.

3. A hearing aid as claimed in claim 1, wherein said second means for lowering high frequencies is a frequency-dependent negative feedback loop.

4. A hearing aid as claimed in claim 1, wherein said second means for lowering high frequencies is a portion of a resonant circuit.

5. A hearing aid as claimed in claim 1, wherein said second means for lowering high frequencies includes a capacitor of a selected capacitance.

6. A hearing aid as claimed in claim 5, wherein said receiver has an inductance and wherein a further capacitor is connected in parallel with said receiver and wherein said capacitor in said second means for lowering high frequencies is connected in a series branch with said switch means, said series branch being connected in parallel with said receiver so that said capacitor forms a resonant circuit with said inductance of said receiver and wherein said selected capacitance of said capacitor in said resonant circuit provides a comfortable tone for said user during telephone listening.

7. A hearing air as claimed in claim 6, wherein said further capacitor has a capacitance which is lower than the capacitance of said capacitor in said second means for lowering high frequencies.

8. A hearing aid as claimed in claim 7, wherein said capacitance of said capacitor in said second means for lowering high frequencies is approximately twice the capacitance of said further capacitor.

9. A hearing aid as claimed in claim 7 further comprising an actuator connected in series with said further capacitor across said receiver.

10. A hearing aid adaptable for telephone listening comprising:

a microphone which receives incoming audio signals, said incoming audio signals sometimes including telephone audio signals;

an amplifier connected to said microphone for amplifying output signals from said microphone, thereby producing amplified audio signals;

a receiver connected to an output of said amplifier;

means connected to said means for amplifying for lowering the amplitudes of high frequency components in said amplified audio signals; and a switch, a resistor and a capacitor connected in series to an output of said amplifier, said capacitor and said resistor in combination lowering the amplitudes of high frequency components in said amplified audio signals differently from said means for lowering to provide a comfortable tone for a user of said hearing aid during telephone listening, and said switch being operable by said user to connect said resistor and said capacitor to said output of said amplifier during telephone listening when said telephone audio signals are thus included in said audio signals.

11. A hearing aid adaptable for telephone listening comprising:

a microphone which receives incoming audio signals, said incoming audio signals sometimes including telephone audio signals;

an amplifier connected to said microphone for amplifying output signals from said microphone, thereby producing amplified audio signals;

a receiver connected to an output of said amplifier;

means connected to said means for amplifying for lowering the amplitudes of high frequency components in said amplified audio signals; and a switch, a resistor and a capacitor connected in series in a feedback loop across said amplifier, said resistor and said capacitor in combination lowering the amplitudes of high frequency components in said amplified audio signals differently from said means for lowering to provide a comfortable tone for a user of said hearing air during a telephone listening, and said switch being operable by said user to connect said resistor and said capacitor across said amplifier during telephone listening when said telephone signals are thus included in said audio signals.

12. A hearing aid adaptable for telephone listening comprising:

a microphone which receives incoming audio signals;

an amplifier connected to said microphone for amplifying output signals from said microphone;

a receiver having an inductance connected to an output of said amplifier;

a first capacitor and an actuator both connected permanently in series across said receiver and a second capacitor connected in series across said receiver with a switch, said switch being operable by a user of said hearing aid to create a resonant circuit including said inductance of said receiver and said second capacitance during telephone listening by said user, said second capacitor having a capacitance selected to provide a comfortable tone to said user during said telephone listening.

* * * * *